US005918547A

United States Patent [19]

Bullock et al.

[11] Patent Number: 5,918,547

[45] Date of Patent: Jul. 6, 1999

[54] ROLLER BEARING ADAPTER STABILIZER BAR

[75] Inventors: Robert L. Bullock, Antioch; Armand P. Taillon, Chicago, both of Ill.

[73] Assignee: Standard Car Truck Company, Park Ridge, Ill.

[21] Appl. No.: 08/971,297

[22] Filed: Nov. 17, 1997

Related U.S. Application Data

[63] Continuation-in-part of application No. 08/682,842, Jul. 12, 1996, Pat. No. 5,735,216, which is a continuation-in-part of application No. 08/365,414, Dec. 28, 1994, abandoned.

[51] Int. Cl.[6] ..... B61F 15/00

[52] U.S. Cl. ..... 105/218.1; 105/220; 105/224.1

[58] Field of Search ..... 105/218.1, 219, 105/220, 224.1, 225

[56] References Cited

U.S. PATENT DOCUMENTS

| | | | |
|---|---|---|---|
| 2,347,387 | 4/1944 | Aurien | 105/218.1 |
| 4,676,172 | 6/1987 | Bullock | 105/224.1 |
| 5,090,333 | 2/1992 | Bieker et al. | 105/218.1 |
| 5,503,084 | 4/1996 | Goding et al. | 105/218.1 |
| 5,735,216 | 4/1998 | Bullock et al. | 105/218.1 |

FOREIGN PATENT DOCUMENTS

| | | | |
|---|---|---|---|
| 1149041 | 5/1963 | Germany | 105/218.1 |

*Primary Examiner*—Mark T. Le

*Attorney, Agent, or Firm*—Dorn, McEachran, Jambor & Keating

[57] ABSTRACT

A three-piece rail car truck has a pair of side frames, a pair of wheelsets and a roller bearing adapter seated on each end of each wheelset. Each side frame has pedestal jaws formed and adapted to seat upon each roller bearing adapter. The improvement comprises a stabilizer bar connected between each roller bearing adapter and adjacent portions of a side frame, with the stabilizer bars resisting unsquaring relative movement between the wheelsets and side frames.

6 Claims, 3 Drawing Sheets

Fig. 1.
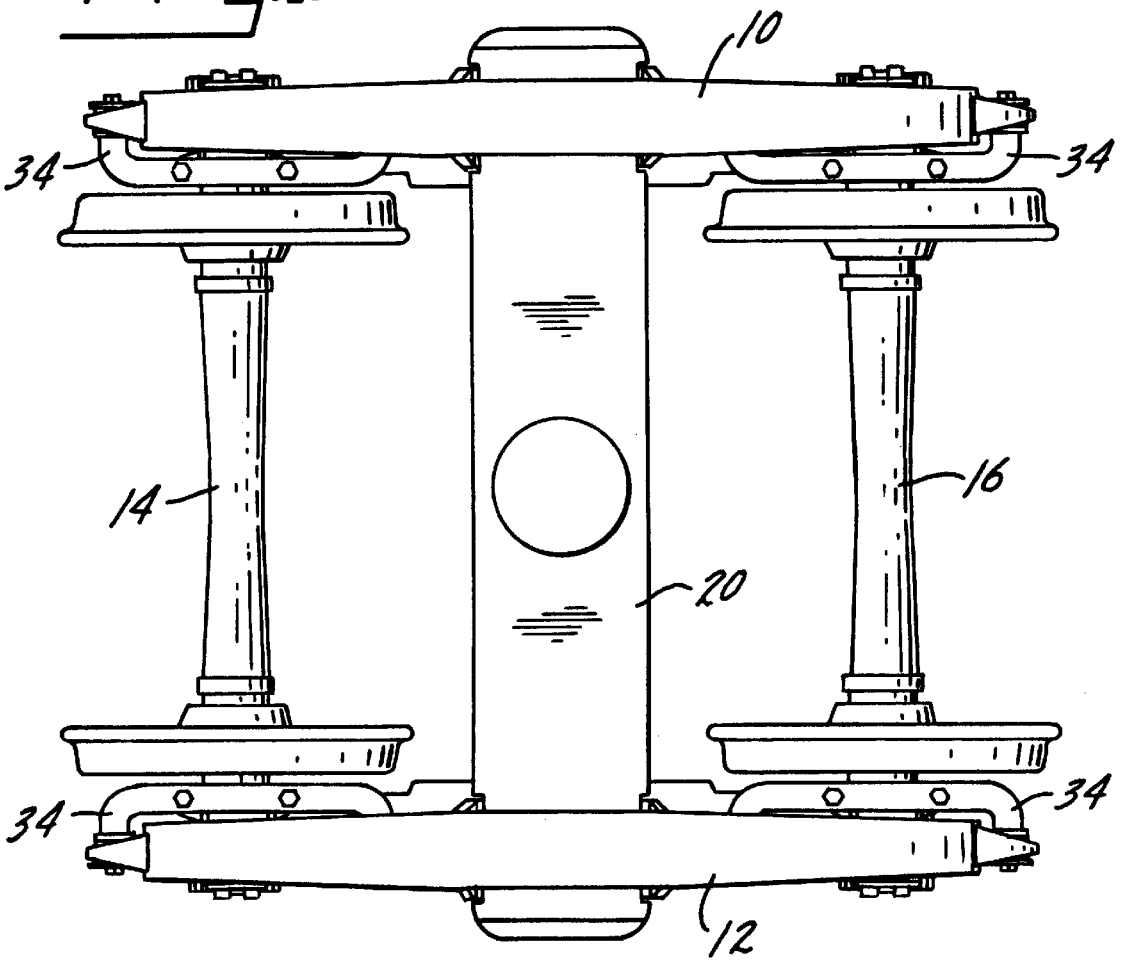
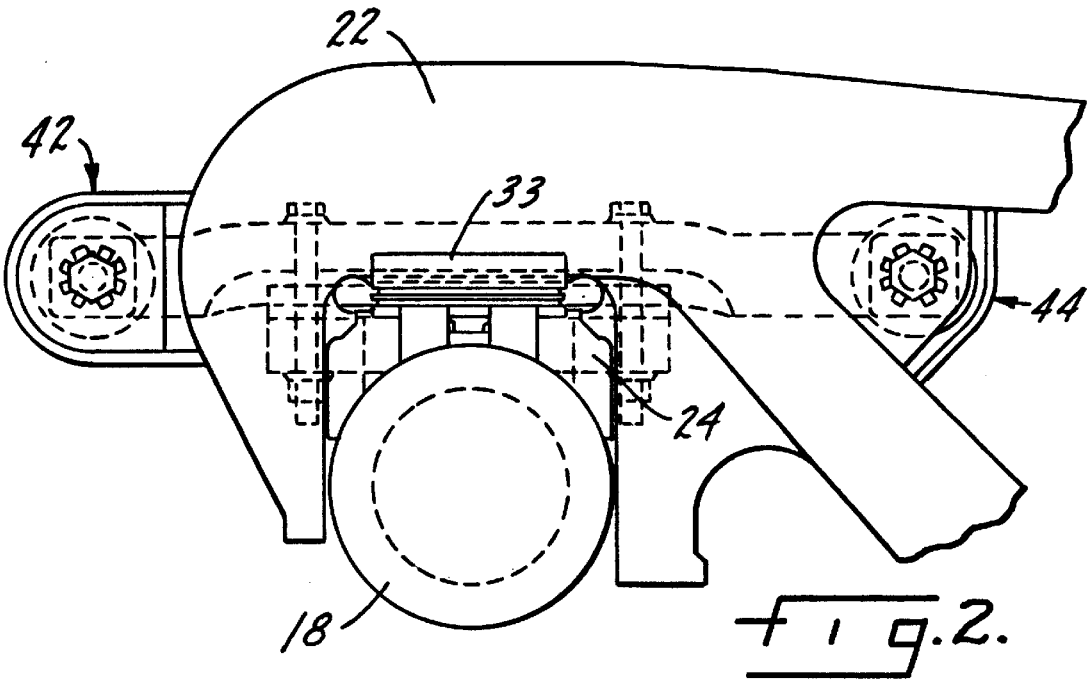
Fig. 2.

Fig. 5.
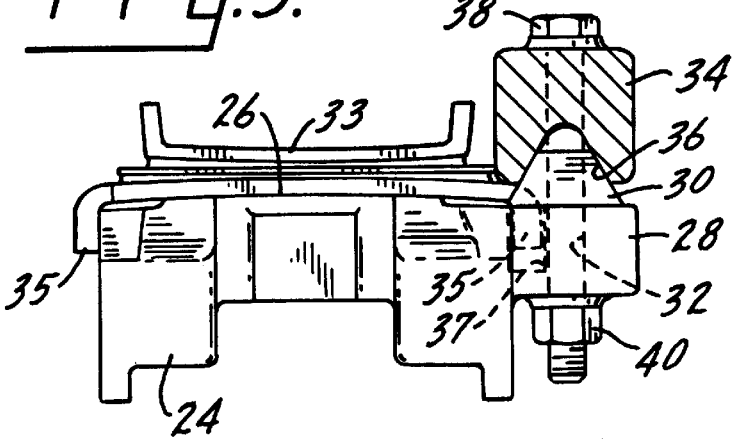
Fig. 7.
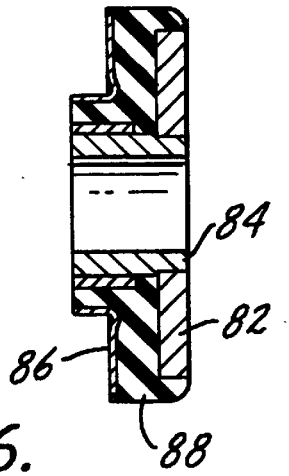
Fig. 6.
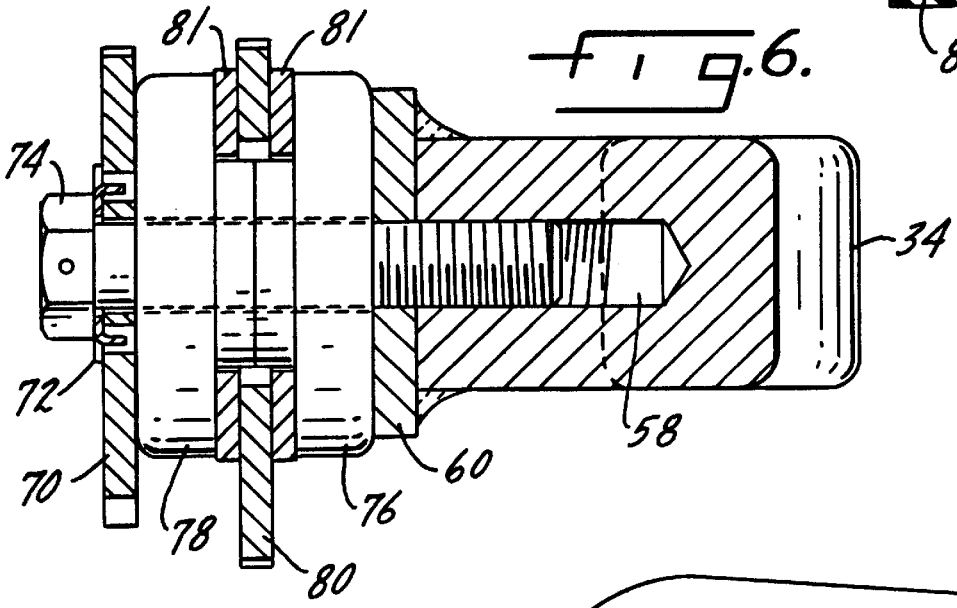
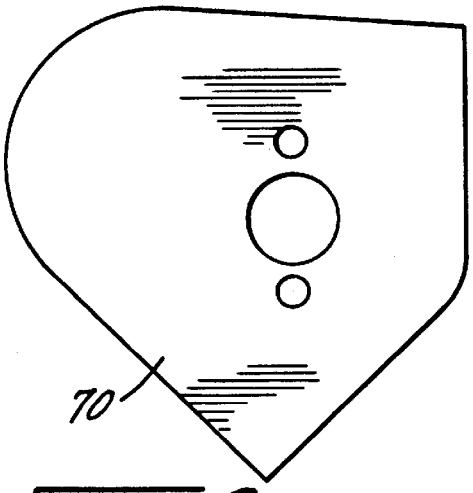
Fig. 8.
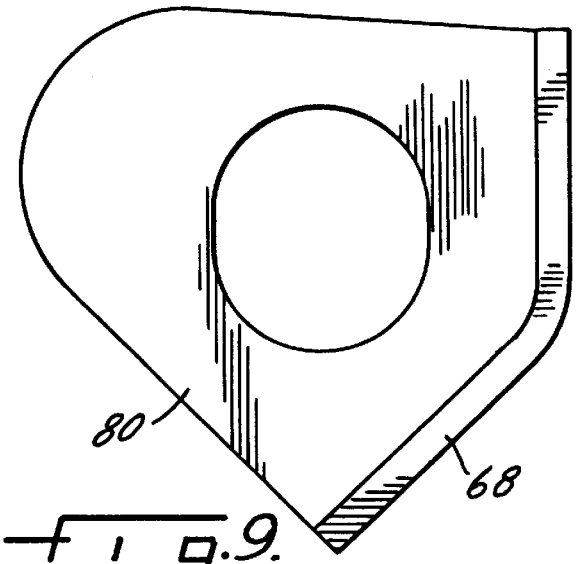
Fig. 9.

ROLLER BEARING ADAPTER STABILIZER BAR

This is Continuation-In-Part of U.S. patent application Ser. No. 08/682,842, filed on Jul. 12, 1996, now U.S. Pat. No. 5,735,216; which is a Continuation-In-Part of U.S. patent application Ser. No. 08/365,414, filed on Dec. 28, 1994, now abandoned.

THE FIELD OF THE INVENTION

The present invention relates to three-piece railroad car trucks, and more particularly to a stabilizer bar which rigidly is attached to the roller bearing adapter and yieldingly attached to the side frame, and resists relative yaw movement between the side frames and wheelsets. By rigidly mounting the stabilizer bar to each of four specially designed roller bearing adapters and yieldingly connecting the opposite ends of the bar to spaced locations on each side frame, it is possible to resist relative yaw movement between the wheelsets and the side frames. By increasing the resistance to relative yaw movement between the wheelsets and the side frames, an increased interaxle shear stiffness, or truck warp stiffness, can be achieved. Warp stiffness, a characteristic in which three-piece trucks are known to be deficient, is critical in determining high speed stability and curving performance. It is the objective of the present invention to increase the warp stiffness of the three-piece truck in order to achieve improved high speed stability and curving performance. The resistance the stabilizer bars provide to the relative yaw movements between the side frames and wheelsets increases the truck warp stiffness, because truck warp is the relative yaw movement between the side frames and the wheelsets.

BACKGROUND OF THE INVENTION

In North American freight railroad service, conventional three-piece freight car trucks having two wheelsets have evolved to satisfy a variety of important operating and economic requirements. Among other requirements, they must be capable of safely supporting and equalizing very high wheel loads over a wide range of track conditions while delivering a high level of economic value to the railroads that use them. In addition to those basic criteria, the trucks and their parts must be interchangeable throughout the system of interconnected railroad networks. The three-piece trucks in service today have, to a large extent, met these requirements because their general designs are simple, flexible, durable and reliable. However, in this evolutionary process a major aspect of truck design for performance efficiency has been largely ignored, design for warp stiffness.

When a conventional three-piece truck encounters sufficient energy in the course of its normal use, usually due to high speed operation, the wheelsets are forced to move laterally relative to the track and relative to one another, causing the instability known as truck hunting. Truck hunting is undesirable, because it causes high lateral forces to be imparted to the rail vehicle and its lading, and because it produces increased drag on the locomotive, resulting in reduced efficiency. Likewise, when a conventional three-piece truck encounters a curve in the normal course of its use, the wheelsets are often forced to move laterally relative to one another, resulting in a condition known as truck warp. Truck warp is undesirable because it causes a high angle of attack to arise between the leading wheelset and the rail, resulting in high rates of wear on the rails and wheels.

Whether they are a result of high speed or curving, truck hunting and truck warp are generally characterized by a lateral displacement of the wheelsets relative to one another and a change of the square relationship of the axles relative to the side frames into an angular relationship.

The recent testing of conventional three-piece freight car truck designs has shown that a large proportion of the interaxle shear stiffness which governs their performance is attributable to the side frame pedestal to roller bearing adapter connection. However, the current standard design of this connection has an inherent problem in that it only provides resistance to unsquaring movements between the side frames and wheelsets by means of coulomb friction. Theoretical modeling and real track testing have proven that, in terms of warp stiffness, friction alone is not sufficient to produce optimum efficiency in curving and stability performance. Rather, optimum performance requires that a constant linear spring stiffness exist, in addition to the friction characteristic, between the wheelsets to resist their relative lateral movement.

The side frame to roller bearing adapter connection design is generally characterized by a roller bearing adapter in a loosely fit upside down U-shaped pedestal jaw which allows the relative freedom of the side frame to rotate in yaw and roll with respect to the roller bearing adapter. The connection is comprised of a flat bearing surface on the side frame end, the pedestal, which bears on an arcuate upper bearing surface on the roller bearing adapter, the crown. The connection is completed by a pair of pedestal jaws, one fore and one aft of the roller bearing adapter, each having on its surface a thrust lug for bearing the longitudinal and lateral forces of the roller bearing adapter relative to the side frame. This connection is specified by AAR standards to have a minimum gap between the vertical surfaces of 1/16. Therefore, it forms a loose connection that allows the side frame to rotate in the horizontal plane and roll in the vertical plane relative to the roller bearing adapter. In part, the pedestal connection is designed this way in order to ensure a uniform load distribution on the roller bearing for maximum durability and reliability. However, it is this gap fit connection and the lack of a yaw spring stiffness between the side frame and axle that is the fundamental problem with the interaxle shear stiffness of the three-piece truck.

Another important aspect of the three-piece truck frame is the connection between the roller bearing adapter and the roller bearing. This connection is generally characterized by a very close, uniform fit. Specified in AAR standards, this connection ensures that loads on the roller bearing are evenly distributed and that the roller bearing does not move relative to the roller bearing adapter. As a result, the roller bearing adapter moves rigidly with the roller bearing which moves with the axle.

Prior art structures describing connections between the truck frame and the journal box, journal box adapter or roller bearing adapter exist in different forms and they vary in their configurations and their intended purposes. One prior art structure in particular, Rossell U.S. Pat. No. 2,782,732, describes a device which has as its objective to fix a plate in a pedestal jaw by means of two parallel longitudinal links and one lateral link as a frictional interface interposed between the journal box and suspension element. The described purpose of the prior art structure was to "impose a heavy frictional resistance to the journal boxes in order to increase high speed stability by breaking up the harmonic axle motions which cause hunting." While the Rossell invention may have been effective at improving high speed stability in a box frame truck, it would not be effective at increasing warp stiffness in a three-piece truck.

The usefulness of the prior art structure in Rossell is limited in that it would only be effective and useful on a box frame truck with a primary suspension. As opposed to a three-piece truck, a box frame truck has an integrally cast rectangular unit frame that encompasses and rests on a suspension above the wheelsets'journals. Unlike the three-piece truck, the box frame truck has an inherent warp stiffness, because the basic frame is one large cast piece. When attached to a box frame, the Rossell three link structure would effectively restrain the described friction plate against lateral and longitudinal movement. In a three-piece truck, however, the three link structure would have no effect on warp stiffness because the link structure is designed to resist translation and would not effectively resist the relative yaw movements that occur between the side frame and roller bearing adapter. This is because Rossell describes a link that is connected from the truck frame to the roller bearing adapter with single point, flexible, jointed ends which can only resist forces in tension and compression and not in rotation.

Another aspect of the prior art in Rossell is that it describes a structure that connects the truck frame with a friction plate that is interposed between the journal box and the suspension element. In the modern three-piece truck, however, the roller bearing adapter and the roller bearing have such a close fit that they are the functional equivalent of the journal boxes of the old technology. Therefore, the friction plate described in Rossell is not the functional equivalent of the roller bearing adapter. Rather, it is the functional equivalent of a wear plate interposed, in the three-piece truck, between the roller bearing adapter crown and the side frame pedestal. Such a structure, in the three-piece truck, would have no effect whatsoever.

SUMMARY OF THE INVENTION

This is a continuation-in-part of copending application Ser. No. 08/682,842, filed Jul. 12, 1996, which is a continuation-in-part of application Ser. No. 08/365,414, filed Dec. 28, 1994, now abandoned.

The present invention relates to three-piece freight car trucks, and in particular to a three-piece freight car truck which increases warp stiffness.

Another purpose of the invention is a freight car truck design having increased interaxle shear stiffness while permitting limited rolling movement between the side frame and wheelsets.

Another purpose of the invention is a side frame/wheelset support system for a rail car truck which utilizes a stabilizer bar connected between each roller bearing adapter and adjacent portions of each side frame to resist relative yaw movement between the side frames and the wheelsets.

Another purpose of the invention is a side frame/wheelset support system, as described, in which the stabilizer bar is rigidly mounted to the roller bearing adapter, with ends extending away from the roller bearing adapter, parallel to the longitudinal axis of the side frame, and attached at spaced locations to the side frame.

Another purpose of the invention is a side frame/wheelset support system, as described, in which the stabilizer bar has yielding connections with the side frame to permit limited side frame rolling movement relative to its supporting wheelset about an axis drawn longitudinally, along the side frame, between the center points of the side frame's two journal boxes.

Another purpose of the invention is a side frame/wheelset support system as described, in which the stabilizer bar has movable or yielding connections with the side frame to resist longitudinal and lateral translation movements between the ends of the stabilizer bar and the side frame.

Another purpose of the invention is a side frame/wheelset support system as described, in which the roller bearing adapter coacts with the roller bearing on the wheelset as an integral part of the wheelset such that the roller bearing adapter moves in unison with the wheelset.

Another purpose of the invention is a side frame/wheelset support system as described, in which the stabilizer bar coacts with the roller bearing adapter and the side frame and provides resistance to relative yaw movement between the side frame and the wheelset. The relative yaw movement which occurs between the side frame and the wheelset causes an angular shift to occur between the side frame and the wheelset from a square to an obtuse or an acute angle. The angular shift which occurs between the side frame and the wheelset causes a deflection to occur in the stabilizer bar. The deflection which occurs in the stabilizer bar creates a counter rotational force on the roller bearing adapter relative to the side frame which is zero only when the side frame is in the square angular position relative to the roller bearing adapter. The counterrotational force which is created on the roller bearing adapter is transferred directly to the wheelset which is continuously square relative to the roller bearing adapter. The resistance to relative yaw rotation which is created between the side frames and the wheelsets causes an increase in the three-piece truck frame warp stiffness, because warp stiffness is a function of the relative yaw stiffness between the side frames and the wheelsets.

Other purposes will appear in the ensuing specification, drawings and claims.

BRIEF DESCRIPTION OF THE DRAWINGS

The invention is illustrated diagrammatically in the following drawings wherein:

FIG. 1 is a top plan view of the rail car truck of the present invention;

FIG. 2 is a side view illustrating the side frame roller bearing adapter connection;

FIG. 5 is a section along plane 5–5 of FIG. 4;

FIG. 6 is a section along plane 6–6 of FIG. 4;

FIG. 7 is a vertical section of the center bonded mounting;

FIG. 8 is a side view of a locking plate; and

FIG. 9 is a side view of a channel plate.

DESCRIPTION OF THE PREFERRED EMBODIMENT

Figures 3, 4:
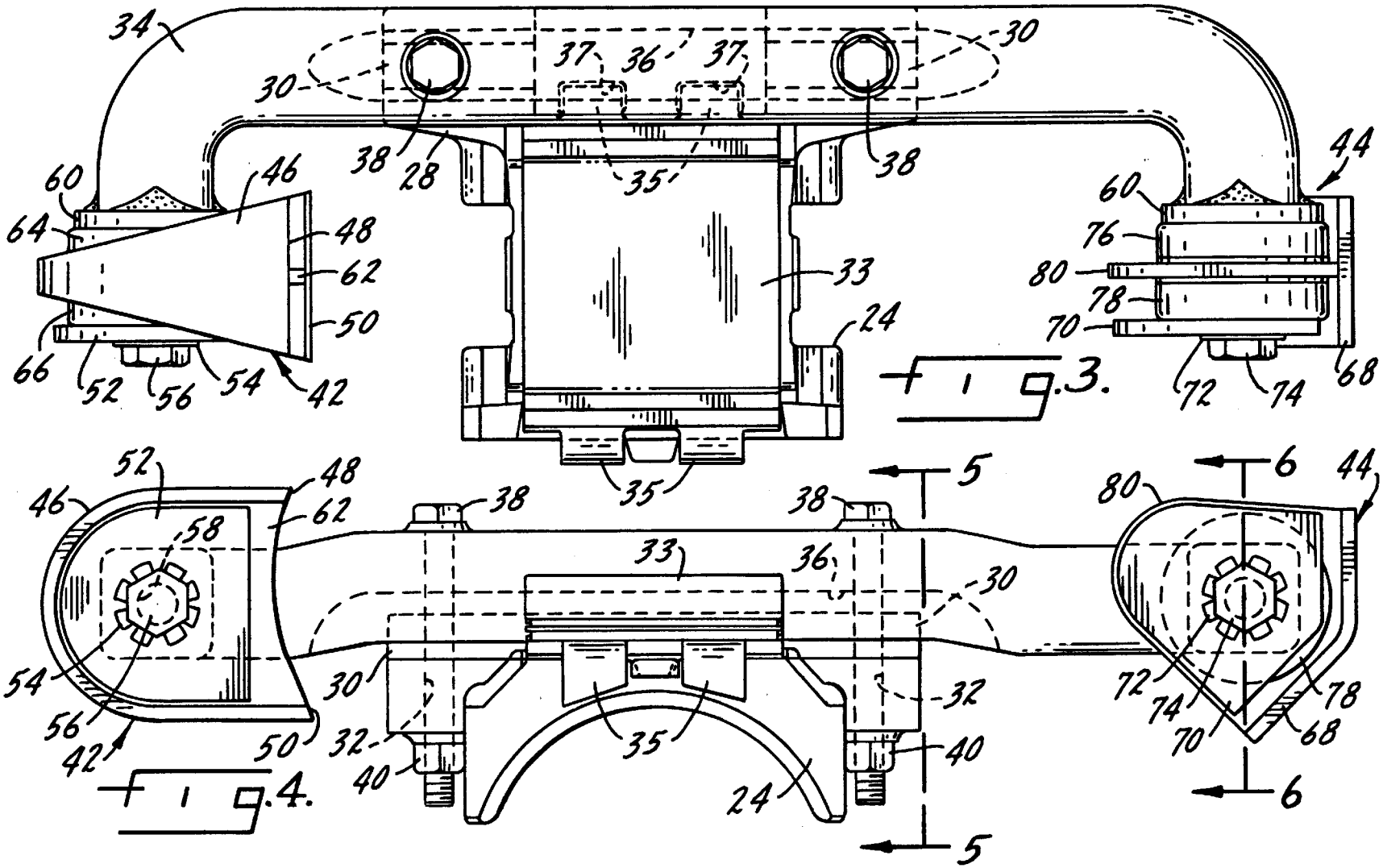
FIG. 3 is a top view illustrating the stabilizer bar roller bearing adapter connection.
FIG. 4 is a side view illustrating the stabilizer bar roller bearing adapter connection.

The present invention relates to freight car trucks and specifically to an improved interconnection between the side frame and the supporting wheelsets which will improve truck performance in high speed operation and curving. The truck design disclosed herein will increase warp stiffness or inter-axle shear stiffness or the resistance to the unsquaring forces which are applied to the truck during operation. A stabilizer bar is rigidly connected to the inboard side of each roller bearing adapter and extends parallel to the longitudinal axis of the side frame to adjacent portions of the side frame. The connections between the stabilizer bar and the side frame are yielding, providing resistance to relative lateral and longitudinal translational movement and permitting limited rolling movement of the side frame relative to the wheelsets about an axis drawn between the side frame's journal box centers.

In a conventional three-piece freight car truck, the interaxle shear stiffness which controls stability and curving performance is contributed mostly by the side frame pedestal to roller bearing adapter connection. The problem with the current design of this connection is that it only provides interaxle shear stiffness by means of coulomb friction. The connection does not provide the linear yaw spring stiffness necessary to provide adequate warp stiffness.

In particular, the frictional resistance characteristic is comprised of two modes of action, static and kinetic friction. The static mode is characterized by a resistance against applied forces sufficient to resist relative movement between the roller bearing adapter and the side frame and it is substantially higher in resistance force than the kinetic mode. The kinetic mode is characterized by the resistance imposed while the side frame is rotating, in a sliding fashion in yaw relative to the roller bearing adapter. At low speeds and under moderate curving conditions, the static mode of frictional resistance effectively resists relative yaw movement between the side frame and roller bearing adapter. However, at higher speeds and under severe curving conditions, the input forces overpower the static mode of frictional resistance and cause the side frames to slide in kinetic yaw movement relative to the roller bearing adapters.

By applying a yaw spring stiffness to the connection between the side frames and roller bearing adapters, it is possible to dramatically increase the warp stiffness of the conventional freight car truck. The present invention provides a stiff beam, the stabilizer bar, connected between the side frame and the roller bearing adapter as a yaw spring which increases warp stiffness. The stabilizer bar is joined generally at its midpoint to the roller bearing adapter by a rigid connection and on both ends by yielding connections to adjacent locations on the side frame. The rigid connection between the stabilizer bar and the roller bearing adapter provides a cantilevered beam stiffness to the stabilizer bar. The yielding connections of the stabilizer bar to the side frame provides resistance to translational movement of the cantilevered ends of the stabilizer bar relative to the side frame. Such connections also permit a limited degree of rolling movement between the side frame and the roller bearing adapter necessary to ensure optimum roller bearing life and performance.

In FIG. 1, a typical freight car truck includes a pair of side frames 10 and 12, each of which is seated upon wheelsets 14 and 16. Each of the wheelsets has roller bearings indicated at 18 and the side frames are seated upon the roller bearings in a manner to be described. The typical three-piece freight car truck is completed by a bolster 20 which normally will be spring supported in windows of the side frames 10 and 12.

As shown particularly in FIG. 2, each side frame has a pedestal 22 which is seated upon a roller bearing adapter 24. As is conventional, the upper surface 26 of the roller bearing adapter is formed in the shape of a small crown with a radius of approximately 60 inches. This is a standard AAR mandated roller bearing adapter surface which will be centered on the adapter and provides a degree of roll freedom for the side frame to roll relative to the roller bearing adapter.

The roller bearing adapter has, at its inboard side, an outwardly extending shoulder or projection 28 which in turn supports two spaced truncated upwardly extending projections 30 each of which has a bore 32. A stabilizer bar 34 has a downwardly facing truncated recess 36 which mates with the projections 30 to form a solid and rigid connection between the stabilizer bar and the roller bearing adapter. Headed bolts 38 and cooperating nuts 40 are used to bolt the stabilizer bar to the inboard side of the roller bearing adapter. The roller bearing adapter carries a pad 33 on the upper surface thereof, which pad has a pair of extensions 35 on each side thereof. The extensions 35 extend into recesses 37 on the stabilizer bar.

Each stabilizer bar is connected to a side frame at two spaced locations, one on each side of the connection between the stabilizer bar and the roller bearing adapter. There is an outboard connection indicated at 42 and an inboard connection indicated at 44. Functionally each of the connections are the same. Focusing on the outboard connection 42 there is a flange plate 46 shown in FIGS. 3 and 4 which has edges 48 and 50 each of which will be welded to the side frame forming a mounting for the stabilizer bar. Each outboard connection 42 will include a locking plate 52 which forms the support for a washer 54 and a bolt 56 with the bolt extending through the connection and being threaded into a bore 58 in the stabilizer bar (note FIG. 6). Located between the locking plate 52 and the flange 60 of the stabilizer bar is a channel plate 62 with the channel plate spacing two elastomeric yielding elements 64 and 66. The elastomeric elements 64 and 66 provide a degree of yielding movement between the side frame and the stabilizer bar. In effect they provide a resilient bearing. This resilient bearing permits movement in multiple planes or directions between the stabilizer bar and the side frame. This connection can permit rolling of the side frame relative to the roller bearing adapter; it can permit lateral movement between the stabilizer bar and side frame; it can permit movement in many different directions simply because the connection is formed of an elastomeric element which can yield, depending upon the directions the rigid components to which it is connected are forced to move during truck operation. The yielding connection formed of the two spaced yielding elements may be described as a center bonded bushing. It is formed of an elastomeric material which has a greater degree of yieldability than metal and it can absorb vibration and impact between the adjacent steel elements as the truck moves over the railroad track in the conventional manner. The center bonded bushing has the ability to not only strengthen the connection between the stabilizer bar and side frame and thus the connection between the roller bearing adapter and side frame, but to absorb what might be otherwise damaging forces to this connection.

The inboard connection is similar in function to the outboard connection, but is slightly different in configuration. The inboard connection 44 includes a flange plate 68, a locking plate 70, a washer 72 and a bolt 74. The spaced elastomeric elements 76 and 78 are separated by a channel plate 80 and holding rings 81. Each of the elastomeric elements 64, 66, 76 and 78 are identical and are shown in detail in FIG. 7. Each include a washer 82, an inner sleeve 84 and a somewhat L-shaped support member 86. Between these various elements is formed the elastomeric body 88 of the elastomeric member. As can be seen, the elastomeric member will provide yielding resistance to compressive forces and to forces in a sheer direction.

Of primary importance in the invention is the provision of a stiffening connection between the side frame and the roller bearing adapter, resisting relative yaw movement between these elements and thus restraining the unsquaring forces applied to the truck between the wheelsets and the side frames. The stabilizer bar provides interaxle shear stiffness in the conventional three-piece truck by creating a resistance to yaw movement between the roller bearing adapter and the side frame. It does this in such a manner as to permit rolling movement between the side frame and the wheelset, which movement does not in any way limit the yaw restraint provided by the stabilizer bar.

The invention as described is suitable for both new truck construction and as a retrofit for existing trucks. In the retrofit situation the existing roller bearing adapter will be replaced by the described roller bearing adapter having the support shoulder for the stabilizer bar. The flange plates will be welded in the desired locations on the side frame and then the stabilizer bar can be connected between the side frame and the roller bearing adapter.

Whereas the preferred form of the invention has been shown and described herein, it should be realized that there may be many modifications, substitutions and alterations thereto.

The embodiments of the invention in which an exclusive property or privilege is claimed are defined as follows:

1. A three-piece rail car track having a pair of side frames, a bolster extending between said side frames, a pair of wheelsets, roller bearing adapters, each of said roller bearing adapters being seated on an end of said wheelsets, each of said side frames having a pedestal at each end thereof formed and adapted to seat upon one of the roller bearing adapters, the improvement comprising a stabilizer bar connected between each of said roller bearing adapters and one of said side frames, the connection between each of said stabilizer bars and one of the roller bearing adapters being rigid, each said stabilizer bar being yieldingly connected to one of said side frames at spaced locations, one on each side of the stabilizer bar connection to the roller bearing adapter, each of said stabilizer bars being significantly less stiff than an axle or a side frame and functioning as a yaw spring stiffness between said axle and side frame, thereby resisting unsquaring relative movement between the wheelsets and side frames, each said connection between one of said stabilizer bars and one of the side frames, having an arrangement that permits relative rolling motion between each of said roller bearing adapters and the side frame.

2. A three-piece rail car truck having a pair of side frames, a bolster extending between said side frames, a pair of wheelsets, roller bearing adapters, each of said roller bearing adapters being seated on an end of said wheelsets, each of said side frames having a pedestal at each end thereof formed and adapted to seat upon one of the roller bearing adapters, the improvement comprising a stabilizer bar connected between each of said roller bearing adapters and one of said side frames, the connection between each of said stabilizer bars and one of the roller bearing adapters being rigid, each said stabilizer bar being yieldingly connected to one of said side frames at spaced locations, one on each side of the stabilizer bar connection to the roller bearing adapter, each said connection between a stabilizer bar and one of said side frames including an elastomeric member, each of said stabilizer bars being significantly less stiff than an axle or a side frame and functioning as a yaw spring stiffness between said axle and side frame, thereby resisting unsquaring relative movement between the wheelsets and side frames, each said connection between one of said stabilizer bars and one of the side frames, having an arrangement that permits relative rolling motion between each of said roller bearing adapters and the side frame.

3. The rail car truck of claim 2 wherein each said connection between one of said stabilizer bars and one of said side frames includes two elastomeric members separated by a rigid member.

4. The rail car truck of claim 2 wherein each said side frame and stabilizer bar connection includes a channel plate attached to said side frame and attached to said elastomeric member.

5. The rail car truck of claim 4 wherein each said side frame and stabilizer bar connection includes a locking plate and a bolt extending through said locking plate and said elastomeric member.

6. The rail car truck of claim 5 wherein the bolt of each said side frame and stabilizer bar connection extends into the stabilizer bar.

* * * * *